US011072925B2

(12) United States Patent
An et al.

(10) Patent No.: US 11,072,925 B2
(45) Date of Patent: Jul. 27, 2021

(54) RAPID CONSTRUCTION METHOD FOR FLUSH ASSEMBLY OF THE PREFABRICATED STEEL BEAM AND THE FLOOR SLAB

(71) Applicant: DALIAN UNIVERSITY OF TECHNOLOGY, Dalian (CN)

(72) Inventors: Yonghui An, Dalian (CN); Weilong Huai, Dalian (CN); Feng Pan, Dalian (CN); Da Lv, Dalian (CN); Jinping Ou, Dalian (CN)

(73) Assignee: DALIAN UNIVERSITY OF TECHNOLOGY, Liaoning Province (CN)

( * ) Notice: Subject to any disclaimer, the term of this patent is extended or adjusted under 35 U.S.C. 154(b) by 0 days.

(21) Appl. No.: 16/652,802

(22) PCT Filed: Dec. 12, 2018

(86) PCT No.: PCT/CN2018/120633

§ 371 (c)(1),
(2) Date: Apr. 1, 2020

(87) PCT Pub. No.: WO2020/118563

PCT Pub. Date: Jun. 18, 2020

(65) Prior Publication Data

US 2021/0040741 A1 Feb. 11, 2021

(51) Int. Cl.
*E04B 5/14* (2006.01)
*E04B 5/02* (2006.01)
(Continued)

(52) U.S. Cl.
CPC ..... *E04B 5/14* (2013.01); *E04B 5/023* (2013.01); *E04B 5/10* (2013.01); *E04B 2001/2484* (2013.01)

(58) Field of Classification Search
CPC ... E04B 5/14; E04B 5/023; E04B 5/10; E04B 2001/2484
(Continued)

(56) References Cited

U.S. PATENT DOCUMENTS 1,912,290 A * 5/1933 Marks ..... E04B 5/10 52/432
1,920,920 A * 8/1933 Venzie ..... E04B 5/08 52/483.1
(Continued)

FOREIGN PATENT DOCUMENTS

CN 206016007 U * 3/2017
CN 206016007 U 3/2017
(Continued)

OTHER PUBLICATIONS

Translation and original document Gong Chao CN 206016007 (U) published on/retrieved from: https://worldwide.espacenet.com/publicationDetails/biblio?CC=CN&NR=206016007U&KC=U&FT=D&ND=4&date=20170315&DB=EPODOC&locale=en_EP (Year: 2020).*
(Continued)

*Primary Examiner* — Patrick J Maestri
*Assistant Examiner* — Joseph J. Sadlon
(74) *Attorney, Agent, or Firm* — Muncy, Geissler, Olds & Lowe, P.C.

(57) ABSTRACT

A new design and rapid construction method for flush assembly of prefabricated steel beams and floor slabs is disclosed. The upper flange of prefabricated steel beams is "⎍" shaped, which consists of horizontal flange, vertical flange and top flange. Both beam stiffeners and studs are set on the horizontal flange, in which the former can strengthen the bearing capacity of the beam and avoid its local deformation, and the latter can fix the floor slab; prefabricated
(Continued)

studs and precast concrete inside the vertical flange in the factory are used to constrain the deformation of upper flange. There is no limitation with respect to the form of floor slab, which is connected with the prefabricated steel beam by hitching the prefabricated rebar ring of the floor slab to the welded studs of the upper flange of the prefabricated steel beam.

2 Claims, 3 Drawing Sheets

(51) Int. Cl.
*E04B 5/10* (2006.01)
*E04B 1/24* (2006.01)

(58) Field of Classification Search
USPC ..... 52/263
See application file for complete search history.

(56) References Cited

U.S. PATENT DOCUMENTS 3,130,470 A * 4/1964 Bowden ..... E04G 11/48 249/192
3,324,614 A * 6/1967 Loewenau ..... E04F 15/0247 52/126.6
3,440,789 A * 4/1969 Harding ..... E04B 9/12 52/506.08
3,780,480 A * 12/1973 Cvijanovic ..... E04B 1/215 52/223.4
4,194,330 A * 3/1980 Smith ..... B21D 13/045 52/177
4,205,497 A * 6/1980 Schirm ..... C07F 7/123 52/93.2
4,344,262 A * 8/1982 Berman ..... E04B 5/14 52/223.12
5,218,795 A * 6/1993 Horstketter ..... B28B 23/00 52/125.5
5,488,809 A * 2/1996 Lindsay ..... E04B 5/02 52/143
5,640,814 A * 6/1997 Godfrey ..... E04B 1/34336 280/789
5,809,722 A * 9/1998 Bertsche ..... E04B 5/14 52/262
5,881,527 A * 3/1999 Haseotes ..... E04B 1/0007 52/705
7,134,805 B2 * 11/2006 Yee ..... F16L 13/113 404/50
7,784,235 B2 * 8/2010 Cretti ..... E04C 5/065 52/332
8,181,423 B2 * 5/2012 Bartlett ..... E04B 5/10 52/836
8,359,797 B2 * 1/2013 Lee ..... E04B 1/04 52/259
8,756,898 B1 * 6/2014 Backhaus ..... E04B 5/023 52/745.2
9,255,404 B2 * 2/2016 Willems ..... E04B 5/023
9,506,266 B2 * 11/2016 Foldenauer ..... E04H 1/04
10,132,079 B2 * 11/2018 Zollig ..... E04F 15/04
10,214,896 B2 * 2/2019 Tebo ..... E04B 1/003
10,557,264 B2 * 2/2020 Zavitz ..... E04B 5/17
10,633,853 B2 * 4/2020 Erlebach ..... A47K 3/405
2015/0068138 A1 * 3/2015 Rubel ..... E04B 5/023 52/98
2020/0131763 A1 * 4/2020 Mears ..... E04B 1/3205

FOREIGN PATENT DOCUMENTS

CN 107700667 A 2/2018
CN 207032507 U 2/2018
CN 207672861 U * 7/2018
CN 207672861 U 7/2018
CN 108360723 A 8/2018
WO WO2012148260 A1 11/2012

OTHER PUBLICATIONS

Translation and original document Guo Jianyun CN CN207672861 (U) published on/retrieved from: https://worldwide.espacenet.com/publicationDetails/biblio?CC=CN&NR=207672861U&KC=U&FT=D&ND=4&date=20180731&DB= EPODOC&locale=en_EP (Year: 2020).*
Translation of CN 207672861 U Ceng J et al. provided by LinguaLinx Language Solutions, Inc. Hedley Park Place, 433 River Street Troy, NY for the instant U.S. Appl. No. 16/652,802, filed 2021.*
Translation of CN 206016007 U Gong C et al. Schreiber Translations, Inc. for the instant U.S. Appl. No. 16/652,802, filed 2021.*

* cited by examiner

RAPID CONSTRUCTION METHOD FOR FLUSH ASSEMBLY OF THE PREFABRICATED STEEL BEAM AND THE FLOOR SLAB

TECHNICAL FIELD

The present invention relates to a design and rapid construction method for the flush assembly of prefabricated beams and floor slabs used in construction engineering structures. The present invention is especially applicable to construction projects when field welding is not convenient to be implemented as well as there is a quite high demand for space height.

BACKGROUND

In the construction engineering structures, the connection method between prefabricated steel beam and floor slab is quite essential, which directly relates to space utilization, construction progress and project cost. At present, the main connecting methods of the assembly beam-slab in our country are putting the floor slab at the top of the beam through different ways to complete the further construction of floor system, which results in a certain reduction of space utilization. Therefore, a construction project in Shanghai foreshore has put forward the requirement of setting the floor slab flush with the upper surface of steel beam. In addition, the existing assembly floor connection methods require a lot of field welding, field formwork and scaffold construction, which will affect the construction quality and progress.

Therefore, there is a need for a new type flush design and rapid construction method of prefabricated steel beam and floor slab to improve space utilization and reduce construction periods. Based on the discussion above, the present invention proposes a new type of prefabricated steel beam and floor slab flush design and its rapid construction method, which can make the top surface of floor slab to be flush with steel beam, avoid field welding, and has the advantages of high space utilization rate as well as more controllable construction quality. When prefabricated concrete slabs or steel plate concrete composite slabs are adopted, there is no requirement for the field formwork and scaffolding, which owns the advantages to improve the construction speed.

SUMMARY OF THE INVENTION

The present invention provides a design and rapid construction method for the flush assembly of prefabricated steel beams and floor slabs; the beam-slab system has the advantages of high space utilization rate, fast construction speed, no field welding, convenient installation, etc.

The technical solution of the invention:

A flush assembly design method of prefabricated steel beams and floor slabs is presented, which mainly aims at the design of prefabricated beam-slab substructures. The prefabricated assembly beam-slab substructure comprises reinforced concrete floor slab 1, prefabricated steel beam 2 and cast-in-place concrete 3 between beams and slabs.

The prefabricated rebar ring 4 is arranged at the end of the reinforced concrete floor slab 1, which is used to connect the vertical pre-welded studs 5 of the prefabricated steel beam 2.

The upper flange of the prefabricated steel beam 2 is " ⎍ " shaped and consists of horizontal flange 6, vertical flange 7 and top flange 8. The height of the vertical flange 7 is the same as the thickness of the reinforced concrete floor slab 1. Beam stiffener 9 is arranged on horizontal flange 6 to improve the stiffness and bearing capacity of horizontal flange 6 and prevent horizontal flange 6 from local deformation. At the same time, the vertical pre-welded studs 5 are welded on the horizontal flange 6. The position of the vertical pre-welded studs 5 corresponds to the prefabricated rebar ring 4 at the end of the reinforced concrete floor slab 1. The inner space composed of vertical flange 7 and top flange 8 is filled with beam flange inner side concrete 10 to prevent the flange from deformation under compression. Horizontal pre-welded studs 11 are set inside the vertical flange 7 to fix the beam flange inner side concrete 10 to prevent its falling off.

A fast construction method for the flush assembly of prefabricated steel beams and floor slabs, when the floor slab is a reinforced concrete floor slab, the steps are shown as follows:

1) Prefabricate the reinforced concrete floor slab 1 in the factory and set the prefabricated rebar ring 4 at the end of the reinforced concrete floor slab.

2) Prefabricate steel beam 2 in the factory; set vertical pre-welded studs 5 and stiffener 9 on horizontal flange 6; the position of vertical pre-welded studs 5 corresponds to the prefabricated rebar ring 4 at the end of reinforced concrete floor slab 1; set horizontal pre-welded studs 11 inside vertical flange 7.

3) Invert prefabricated steel beam 2 and taking its vertical flange 7 and top flange 8 as formwork, then complete pouring the beam flange inner side concrete 10 in the factory, and the horizontal pre-welded bolt 11 is set to fix beam flange inner side concrete 10.

4) On-site assembling; put the reinforced concrete floor slab 1 on the horizontal flange 6 of prefabricated steel beam 2 and hitch the prefabricated rebar ring 4 of the reinforced concrete floor slab 1 to the vertical pre-welded bolt 5 one by one.

5) Taking the horizontal flange 6, vertical flange 7 of prefabricated steel beam 2 and the side of reinforced concrete floor slab 1 as the formwork, pour concrete 3 in the gap between prefabricated steel beam 2 and reinforced concrete floor slab 1 to complete the construction of beam-slab substructure on site.

The floor stated above is not limited to prefabricated reinforced concrete floor slab 1; when the floor slab is the cast-in-place slab, and if scaffolding and supporting formwork are allowed to be used on site, then hitch the prefabricated rebar ring 4 at the end of the floor slab to the vertical pre-welded bolt 5 one by one after finishing supporting formwork, and then pour the concrete on site; if there is no scaffolding on site, use steel plate concrete composite floor slab; pre-welding prefabricated rebar ring 4 at the end of the steel plate or profiled steel plate in the factory, and connecting prefabricated rebar ring 4 of steel plate with vertical pre-welded bolt 5 of prefabricated steel beam 2 during on-site assembly, then pouring concrete on site with steel plate as formwork.

The beneficial effect of the invention is summarized as follows: compared with the existing technology, the prefabricated steel beam and floor flush assembly method proposed by the invention 1) can not only satisfy the bearing capacity requirements of the beam and slab, but also improve the space utilization rate of the construction structure; 2) both of beams and slabs of the invention can be prefabricated in the factory, then construction can be accomplished just by assembling beam and floor slab and pouring a small amount of concrete on site, more than that, scaffolding and formwork can be omitted during the process to realize rapid construction and reduce construction period greatly; 3) the invention avoids field welding and can guarantee construction quality better.

DRAWINGS

Where: 1 reinforced concrete floor slab; 2 prefabricated steel beam; 3 concrete; 4 prefabricated rebar rings; 5 vertical pre-welded stud; 6 horizontal flange; 7 vertical flange; 8 top flange; 9 beam stiffener; 10 beam flange inner side concrete; 11 horizontal pre-welded stud; 12 bottom steel plate when the floor slab is steel plate concrete composite slab.

DETAILED DESCRIPTION

In order to make the above features and advantages of the invention more understandable, in conjunction with the attached drawings, the technical solution of the invention is described in detail below through taking the prefabricated reinforced concrete floor as an example.

Figure 1:
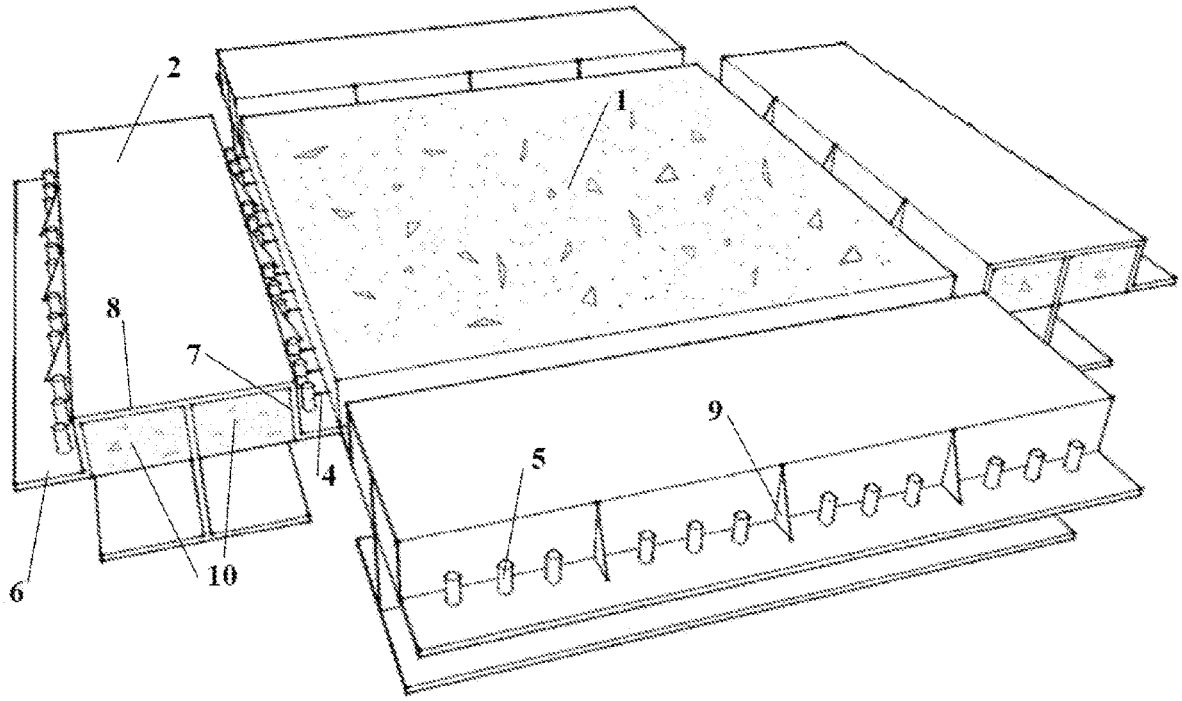
FIG. 1 is a schematic diagram of the prefabricated assembled beam and slab which will be poured by small amount of concrete on site.
Figure 2:
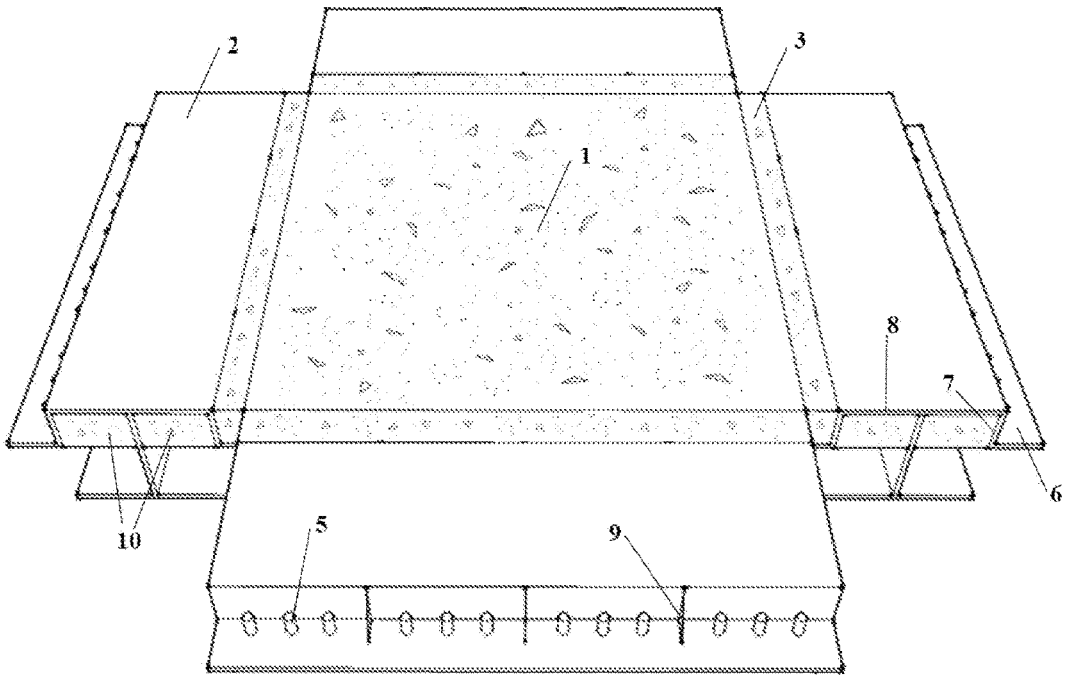
FIG. 2 is a schematic diagram of the prefabricated assembly beam-slab substructure of the invention after the flush construction is accomplished.
Figure 3:
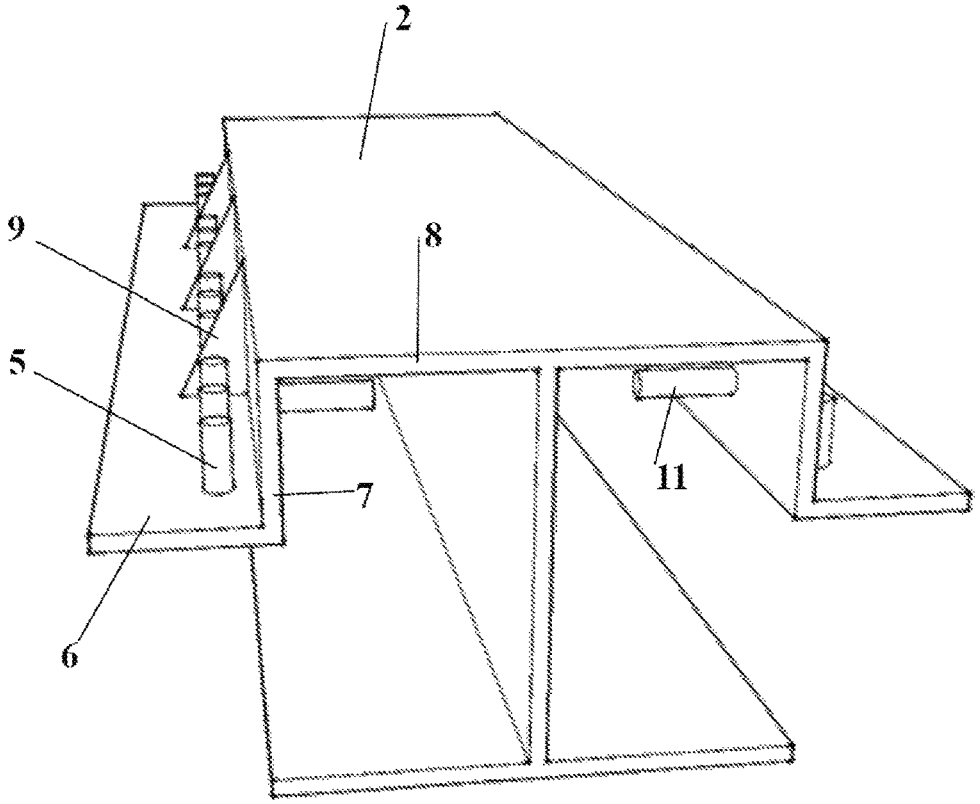
FIG. 3 is a schematic diagram of the prefabricated steel beam of the invention before concrete is poured in the factory.
Figure 4:
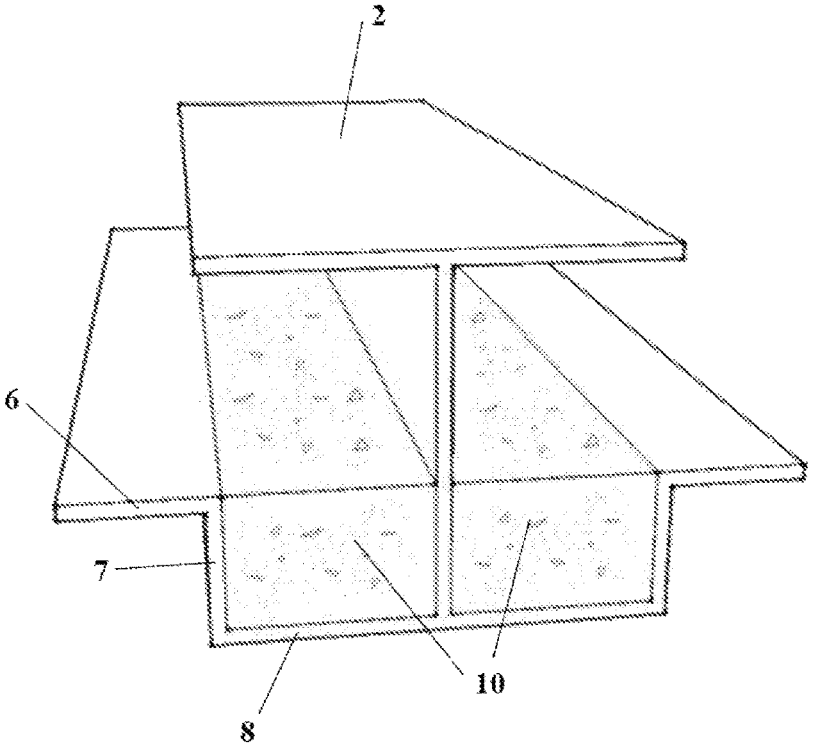
FIG. 4 is a schematic diagram of the prefabricated steel beam of the invention after concrete is poured in the factory.
Figure 5:
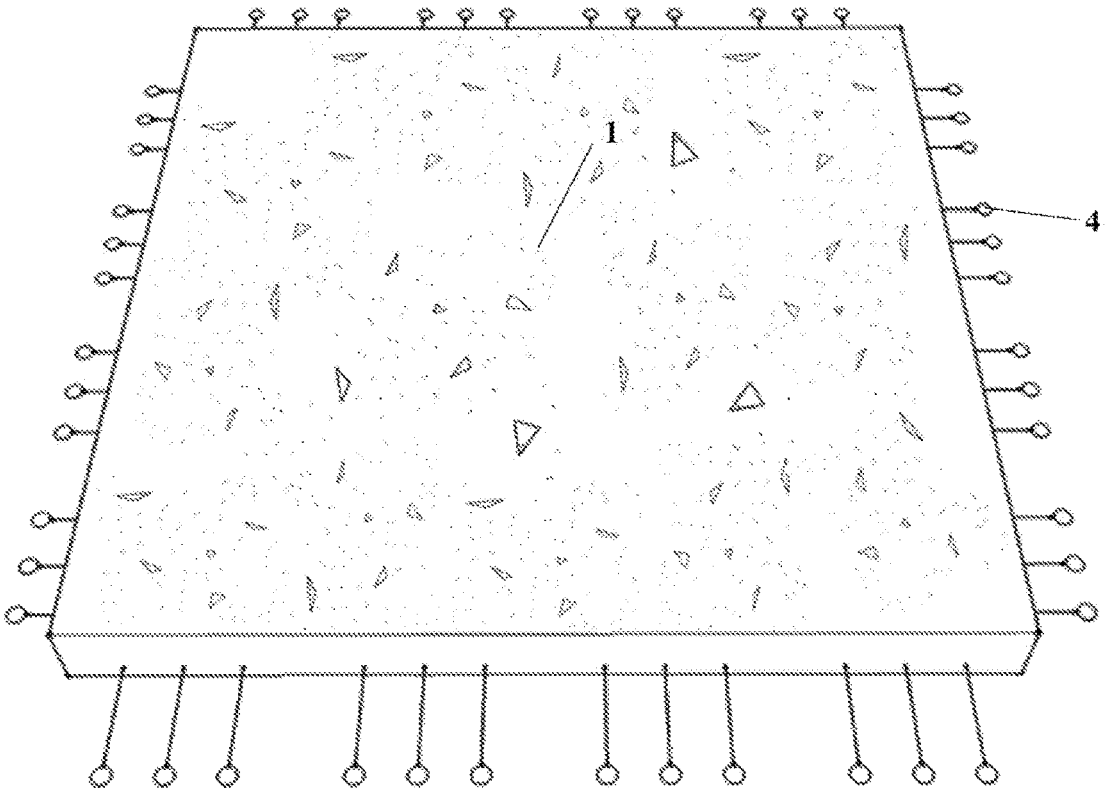
FIG. 5 is a schematic diagram of the prefabricated reinforced concrete floor slab and the prefabricated rebar ring at the end of the floor slab.
Figure 6:
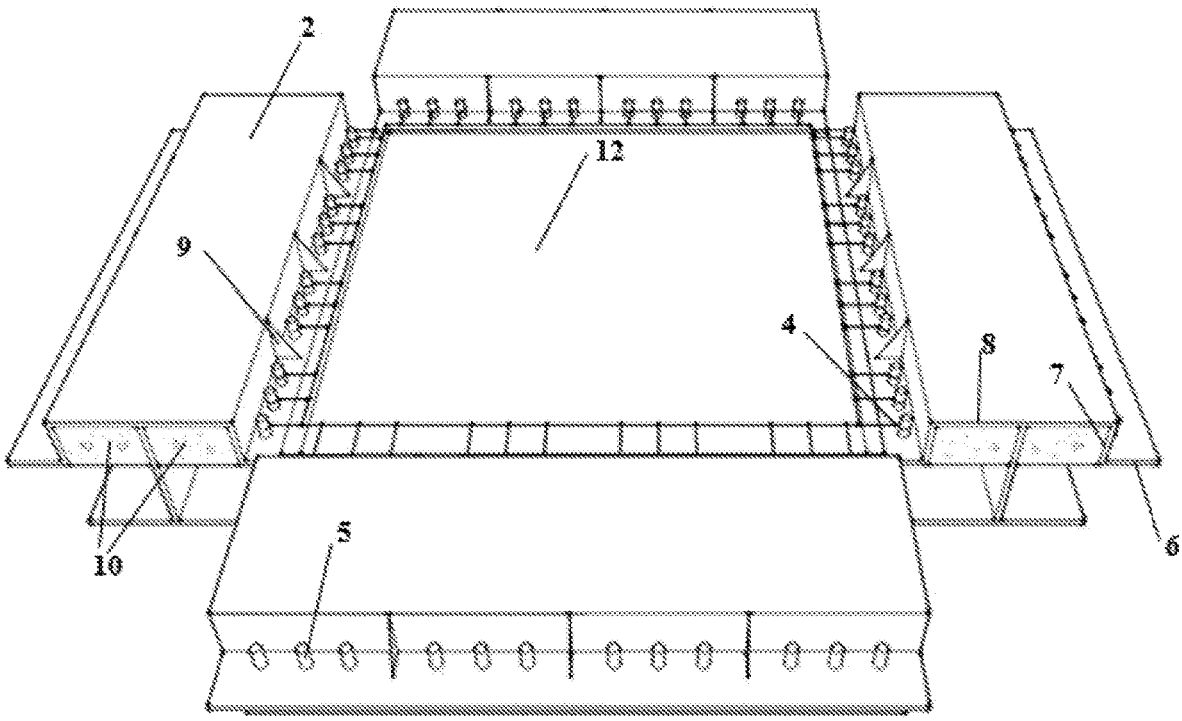
FIG. 6 is a schematic diagram of the state before concrete is poured on site with steel plate as a formwork when steel plate concrete composite floor slab is used in the invention.

As shown in FIG. 1-5, steel prefabricated rebar ring 4 is set at the end of reinforced concrete floor slab 1 to connect with vertical pre-welded stud 5 of prefabricated steel beams 2; the upper flange of the prefabricated steel beam 2 is " ⎍ " shaped, which consists of horizontal flange 6, vertical flange 7 and top flange 8, wherein the height of the vertical flange 7 is the same as the thickness of the reinforced concrete floor slab 1; beam stiffener 9 is arranged on the horizontal flange 6 to improve the stiffness and bearing capacity as well as prevent it from local deformation; at the same time, vertical pre-welded studs 5 are set on the horizontal flange 6, whose position corresponds to the prefabricated rebar ring 4 of the reinforced concrete floor slab 1; the inner space composed of the vertical flange 7 and the top flange 8 is cast with the beam flange inner side concrete 10 to prevent the flange from deformation under compression; the horizontal pre-welded studs 11 are arranged at the inner side of the vertical flange 7 to fix the beam flange inner side concrete 10 to prevent it from falling off.

The construction is carried out as follows:

1) Prefabricate the reinforced concrete floor slab 1 in the factory and set the prefabricated rebar ring 4 at the end of the reinforced concrete floor slab.

2) Prefabricate steel beam 2 in the factory: Set vertical pre-welded studs 5 and stiffener 9 on horizontal flange 6; the position of vertical pre-welded studs 5 corresponds to the prefabricated rebar ring 4 at the end of reinforced concrete floor slab 1; set horizontal pre-welded studs 11 inside vertical flange 7.

3) Invert prefabricated steel beam 2 and taking its vertical flange 7 and top flange 8 as formwork, then complete pouring the beam flange inner side concrete 10 in the factory, and the horizontal pre-welded bolt 11 is set to fix beam flange inner side concrete 10.

4) On-site assembling: Put the reinforced concrete floor slab 1 on the horizontal flange 6 of prefabricated steel beam 2 and hitch the prefabricated rebar ring 4 of the reinforced concrete floor slab 1 to the vertical pre-welded bolt 5 one by one.

5) Taking the horizontal flange 6, vertical flange 7 of prefabricated steel beam 2 and the side of reinforced concrete floor slab 1 as the formwork, pour concrete 3 in the gap between prefabricated steel beam 2 and reinforced concrete floor slab 1 to complete the construction of beam-slab substructure on site.

The invention claimed is:

1. A flush assembly of prefabricated steel beams and floor slabs, wherein the prefabricated assembly beam-slab substructure comprises a reinforced concrete floor slab, a prefabricated steel beam and cast-in-place concrete between beams and slabs;

numerous prefabricated rebar rings are arranged at the end of the reinforced concrete floor slab, which are used to connect vertical pre-welded studs of the prefabricated steel beam;

an upper flange of the prefabricated steel beam is ⎍ hat channel shaped and consists of two horizontal flanges, two vertical flanges and a top flange; a height of the vertical flanges is the same as a thickness of the reinforced concrete floor slab; numerous beam stiffeners are arranged on the horizontal flanges to improve the stiffness and bearing capacity of the horizontal flanges and prevent the horizontal flanges from local deformation; at the same time, the vertical pre-welded studs are welded on the horizontal flange; the position of the vertical pre-welded studs correspond to the prefabricated rebar rings at the end of the reinforced concrete floor slab; an inner space bordered by the vertical flange and the top flange is filled with beam flange inner side concrete to prevent the flanges from deformation under compression; horizontal pre-welded studs are set inside the vertical flange to fix the beam flange inner side concrete to prevent its falling off.

2. A fast construction method for the flush assembly of prefabricated steel beams and floor slabs, wherein, the floor slabs are is a reinforced concrete floor slabs, the steps comprising:

(i) prefabricating the reinforced concrete floor slabs in the factory and setting prefabricated rebar rings at the ends of the reinforced concrete floor slabs;

(ii) prefabricating steel beams in the factory: positioning vertical pre-welded studs and stiffeners on a horizontal flange; of the beam corresponding to the prefabricated rebar rings at the end the of reinforced concrete floor slabs; positioning horizontal pre-welded studs inside a vertical flange of the beam;

(iii) inverting prefabricated steel beam and using the vertical flange and top flange as a formwork, then pouring beam flange inner side concrete in the factory, and the horizontal pre-welded studs set to fix the beam flange inner side concrete;

(iv) assembling: the reinforced concrete floor slabs on the horizontal flanges of prefabricated steel beams and hitching the prefabricated rebar rings of the reinforced concrete floor slabs to the vertical pre-welded bolts one by one;

(v) using the horizontal flanges, and, vertical flanges of the prefabricated steel beams and the side of reinforced concrete floor slabs as the formwork, pouring concrete in the gap between each prefabricated steel beam and reinforced concrete floor slab to complete the construction of a beam-slab structure on site.

* * * * *